US006053747A

United States Patent [19]

Aggus et al.

[11] Patent Number: 6,053,747

[45] Date of Patent: Apr. 25, 2000

[54] CONNECTION DEVICE AND METHOD FOR CONNECTING PRINTED CIRCUIT BOARDS ORIENTED IN NON-PARALLEL PLANES

[75] Inventors: Trevor J. Aggus, Lincroft; Matthew John Gawron, Jackson; George A. Kopacz, Aberdeen, all of N.J.

[73] Assignee: Lucent Technologies Inc., Murray Hill, N.J.

[21] Appl. No.: 09/149,326

[22] Filed: Sep. 8, 1998

[51] Int. Cl.[7] ..... H01R 9/09

[52] U.S. Cl. ..... 439/67; 439/64; 439/628

[58] Field of Search ..... 439/64, 66, 74, 439/67, 75, 628, 638, 77

[56] References Cited

U.S. PATENT DOCUMENTS

| | | | |
|---|---|---|---|
| 4,087,146 | 5/1978 | Hudson, Jr. | 439/67 |
| 5,219,292 | 6/1993 | Dickirson et al. | 439/67 |
| 5,383,788 | 1/1995 | Spencer | 439/67 |
| 5,645,434 | 7/1997 | Leung | 439/74 |
| 5,800,186 | 9/1998 | Ramirez et al. | 439/74 |

*Primary Examiner*—Renee S. Luebke
*Assistant Examiner*—T. C. Patel
*Attorney, Agent, or Firm*—Gibbons, Del Deo, Dolan, Griffinger and Vecchione

[57] ABSTRACT

A circuit board connection device and method for use in an assembly having a first portion and a second portion, wherein a first circuit board is contained within the first portion of the assembly and a second circuit board is contained within the second portion of the assembly. A flat cable is connected to the second circuit board. The flat cable is flexible, yet is rigid enough to support its own weight. Consequently, the flat cable extends upwardly from surface second circuit board and terminates at a free end. A flat cable connector is provided on the first circuit board. The flat cable connector is sized to receive the free end of the flat cable. An alignment collar is placed over the flat cable connector. The alignment collar receives the free end of the flat cable and guides the free end of the flat cable into the flat cable connector as the first portion of the assembly is assembled to the second portion of the assembly. If the free end of the flat cable is not aligned with the flat cable connector, the alignment collar realigns the flat cable to the proper orientation.

21 Claims, 3 Drawing Sheets

CONNECTION DEVICE AND METHOD FOR CONNECTING PRINTED CIRCUIT BOARDS ORIENTED IN NON-PARALLEL PLANES

FIELD OF THE INVENTION

The present invention relates to connection devices and methods that are used to interconnect separate printed circuit boards within a common assembly. More particularly, the present invention relates to connectors that can be used to interconnect printed circuit boards that do not align in parallel planes.

BACKGROUND OF THE INVENTION

Many devices contain multiple printed circuit boards that are electrically interconnected within the device. If a device contains multiple printed circuit boards, the different printed circuit boards are typically interconnected in one of a number of different ways. A first way of interconnecting printed circuit boards is by soldering the different boards together with rigid conductive leads. Since such an interconnection method requires strict adherence to the positioning for soldering of the leads, the method is highly time and labor intensive.

A second way of interconnecting printed circuit boards is by placing corresponding male and female pin connectors on adjacent boards. The male and female pin connectors from different printed circuit boards can then be interconnected when the two printed circuit boards are adjacently placed next to one another so that the pin connectors align. A problem associated with the use of pin connectors is that the male and female pin connectors on different printed circuit boards must be oriented in the same location and in the same plane before the pin connectors will properly interconnect. As a result, the interconnection of circuit boards with pin connectors is typically done manually to ensure proper pin alignment. Also, the use of pin connectors is typically reserved to applications where the pin connectors can be clearly observed during assembly. This eliminates applications where printed circuit boards are interconnected blindly or in an automated fashion.

A third common technique used to interconnect printed circuit boards is through the use of flexible flat cable. The ends of a long piece of flexible flat cable are connected to the different printed circuit boards. Once interconnected, the printed circuit boards are free to move in relation to one another through a wide range. The printed circuit boards are therefore well adapted to be assembled into a device using either a blind assembly procedure or through an automated assembly procedure.

Some problems associated with the use of flexible flat cable are that it is expensive and that it may become obtrusive during assembly. Also many devices that contain multiple printed circuit boards also contain housings. As the housings are assembled, the flexible flat cable may become pinched and damaged within the housing. In addition, present interconnection methods often require that the connectors on the flexible cable be manually aligned with the connectors on the printed circuit boards thereby making the assembly process more involved. In other applications, the flexible flat cable may rest against the circuitry of the printed circuit boards within the assembly. The presence of the flexible flat cable against the circuitry may cause interference to occur in the signals processed by such circuitry. Accordingly, when flexible flat cable is used, great care is often required to ensure the flexible flat cable lays properly within the assembly.

A need therefore exists for a connector device and connection method that can be used to interconnect printed circuit boards that eliminate the described disadvantages associated with prior art techniques.

SUMMARY OF THE INVENTION

The present invention is a circuit board connection device and method for use in an assembly having a first portion, and a second portion, wherein a first circuit board is contained within the first portion of the assembly and a second circuit board is contained within the second portion of the assembly. A flat cable is connected to the second circuit board. The flat cable is flexible, yet is rigid enough to support its own weight. Consequently, the flat cable extends upwardly from surface of the second circuit board and terminates at a free end. A flat cable connector is provided on the first circuit board. The flat cable connector is sized to receive the free end of the flat cable. An alignment collar is placed over the flat cable connector. The alignment collar receives the free end of the flat cable and guides the free end of the flat cable into the flat cable connector as the first portion of the assembly is assembled to the second portion of the assembly. If the free end of the flat cable is not aligned with the flat cable connector, the alignment collar realigns the flat cable to the proper orientation. Accordingly, the first circuit board and the second circuit board may become interconnected in a blind assembly procedure without the need for manual alignment.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION

Although the present invention device and method can be used to assemble most any electronic device that contains printed circuit boards, it is particularly useful in the manufacture and assembly of telephones. Accordingly, by way of example, the present invention device and method will be described within the context of a description for manufacturing and assembling telephones. In addition, although the exemplary embodiment is shown as being utilized with flat cable, it would be understood that other types of cables may also be utilized.

Figure 1:
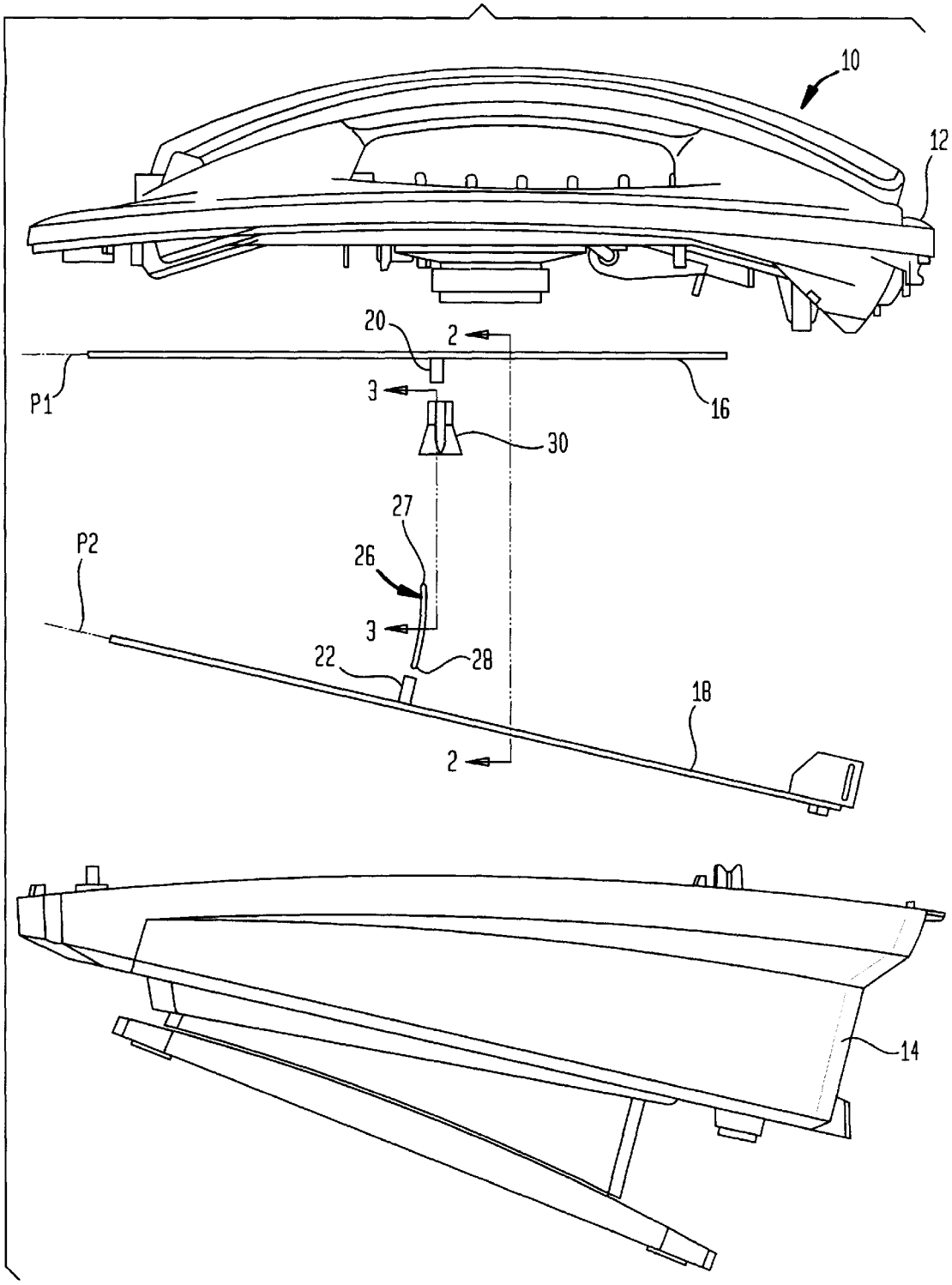
FIG. 1 is an exploded view of an exemplary embodiment of an assembly that incorporates the present invention.

Referring to FIG. 1, a telephone assembly 10 is shown. As the telephone is manufactured, it is assembled into an upper housing subassembly 12 and a lower housing subassembly 14. In one of the last steps in the manufacturing process, the upper housing subassembly 12 is attached to the lower housing subassembly 14 to complete the telephone.

A first printed circuit board 16 is affixed to the upper housing subassembly 12. Similarly, a second printed circuit board 18 is affixed to the lower housing subassembly 14. When the upper housing subassembly 12 is assembled to the lower housing subassembly 14, the first printed circuit board 16 must connect to the lower printed circuit board 18. In the illustrated example, the upper housing subassembly 12 retains the first printed circuit board in a first plane P1. Conversely, the lower housing subassembly 14 retains the second printed circuit board 18 in a second plane P2, which is not parallel to the first plane P1 of the first printed circuit board 16. Furthermore, when the upper housing subassembly 12 is connected to the lower housing subassembly 14, the interconnection of the first printed circuit board 16 to the second printed circuit board 18 is typically a blind assembly procedure, i.e., an assembly procedure that can not be readily viewed by the assembler.

The present invention is a connector device that enables nonparallel printed circuit boards to be interconnected in a blind assembly procedure. The connector device includes two identical female connectors 20, 22. The first female connector 20 is typically soldered or otherwise attached to the upper printed circuit board 16 while the second female connector 22 is soldered or otherwise attached to the lower printed circuit board 18. Both female connectors extend substantially perpendicularly from the printed circuit board to which they are attached. Accordingly, the plane in which the first female connector 20 projects is not the same plane in which the second female connector 22 projects.

Figure 2:
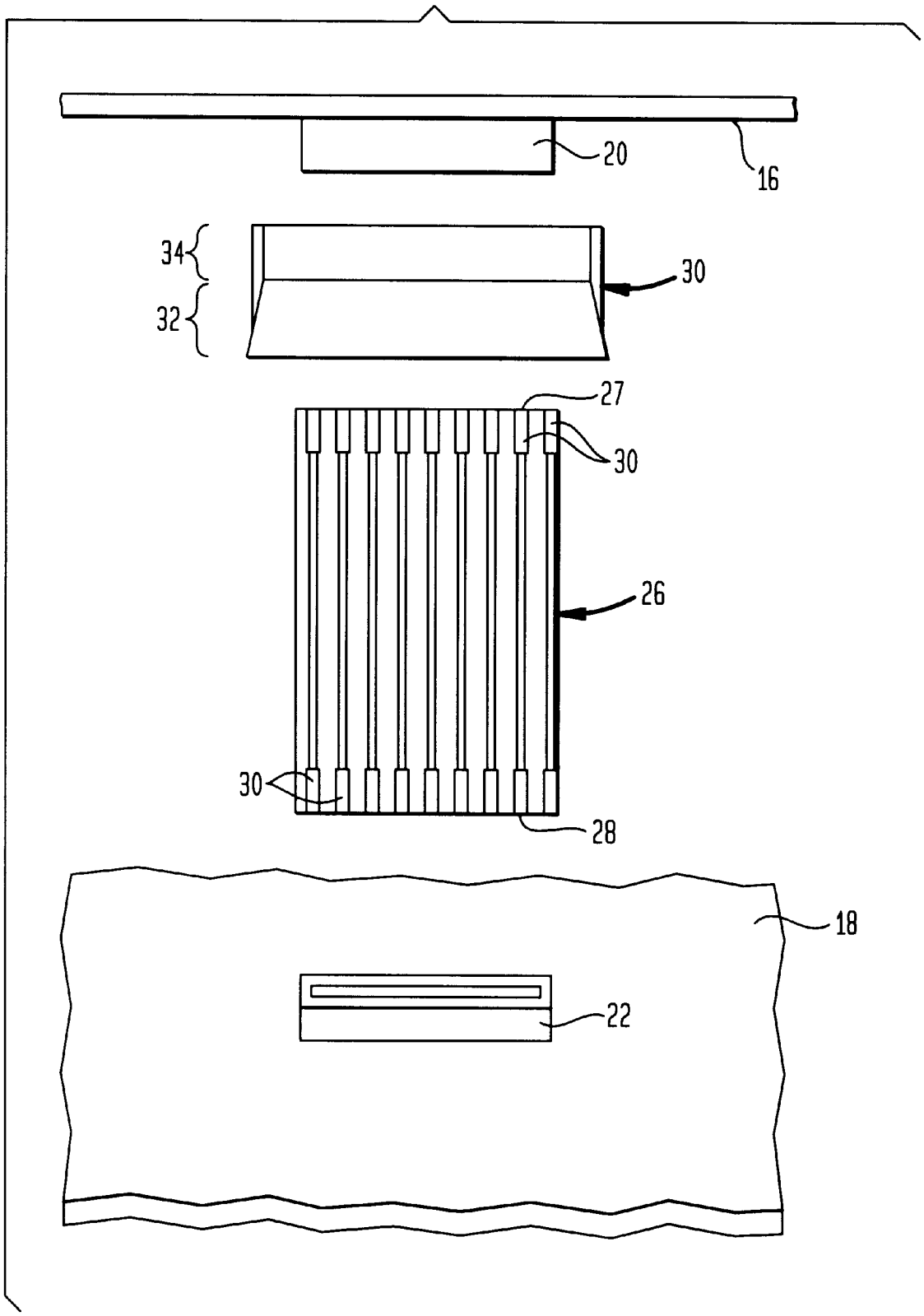
FIG. 2 is a fragmented view of a portion of the embodiment of FIG. 1, viewed along section line 2—2.

Referring to FIG. 2, in conjunction with FIG. 1, it can be seen that a self-supporting flexible flat cable 26 is provided. The flat cable 26 has a top edge 27 and a bottom edge 28. The flat cable is disposed between the first female connector 20 and the second female connector 22. Referring solely to FIG. 2, it can be seen that plated terminations 31 are disposed along the top edge 27 and the bottom edge 28 of the flat cable 26. Conductive lines 32 lead between the various plated terminations along the top edge 27 and the various terminations along the bottom edge 28. Although ten conductive lines 32 are shown in FIG. 2, it should be understood that the flat cable 26 can contain any number of conductive lines and plated terminations and that the width of the flat cable 26 may vary to accommodate the number of conductive lines selected.

The female connectors 20, 22 are adapted to receive the plated terminations 31 at the top edge 27 and bottom edge 28 of the flat cable 26, respectively. Accordingly, the width of the female connectors 20, 22 and the number of terminal receivers within the female connectors 20, 22 can be varied to match that needed to receive the flat cable 26.

The first female connector 20 is not in the same plane as the second female connector 22. Accordingly, in order for the flat cable 26 to span between the first female connector 20 and the second female connector 22, the flat cable 26 must be capable of bending. However, although the flat cable 26 is flexible enough to bend, the flat cable 26 is also rigid enough to support its own weight. Accordingly, the thickness of the flat cable 26 will vary in proportion to the length of the flat cable 26. The longer the flat cable 26, the thicker the flat cable 26 so that it can remain self-supporting.

During assembly, the bottom edge 28 of the flat cable 26 is set within the female connector 22 that extends from the second printed circuit board 18. Since the flat cable 26 is thick enough to be self-supporting, the flat cable 26 remains at its full length with its top edge 27 being freely supported as its upper most point. As the upper housing subassembly 12 (FIG. 1) is joined to the lower housing subassembly 14 (FIG. 1), the top edge 27 of the flat cable 26 is to be received by the first female connector 20 on the first printed circuit board 26. An alignment collar 30 is provided to guide the top edge of the flat cable into the first female connector 20. The alignment collar 30 has an internally tapered mouth section 32 that leads into a base section 34.

Figure 3:
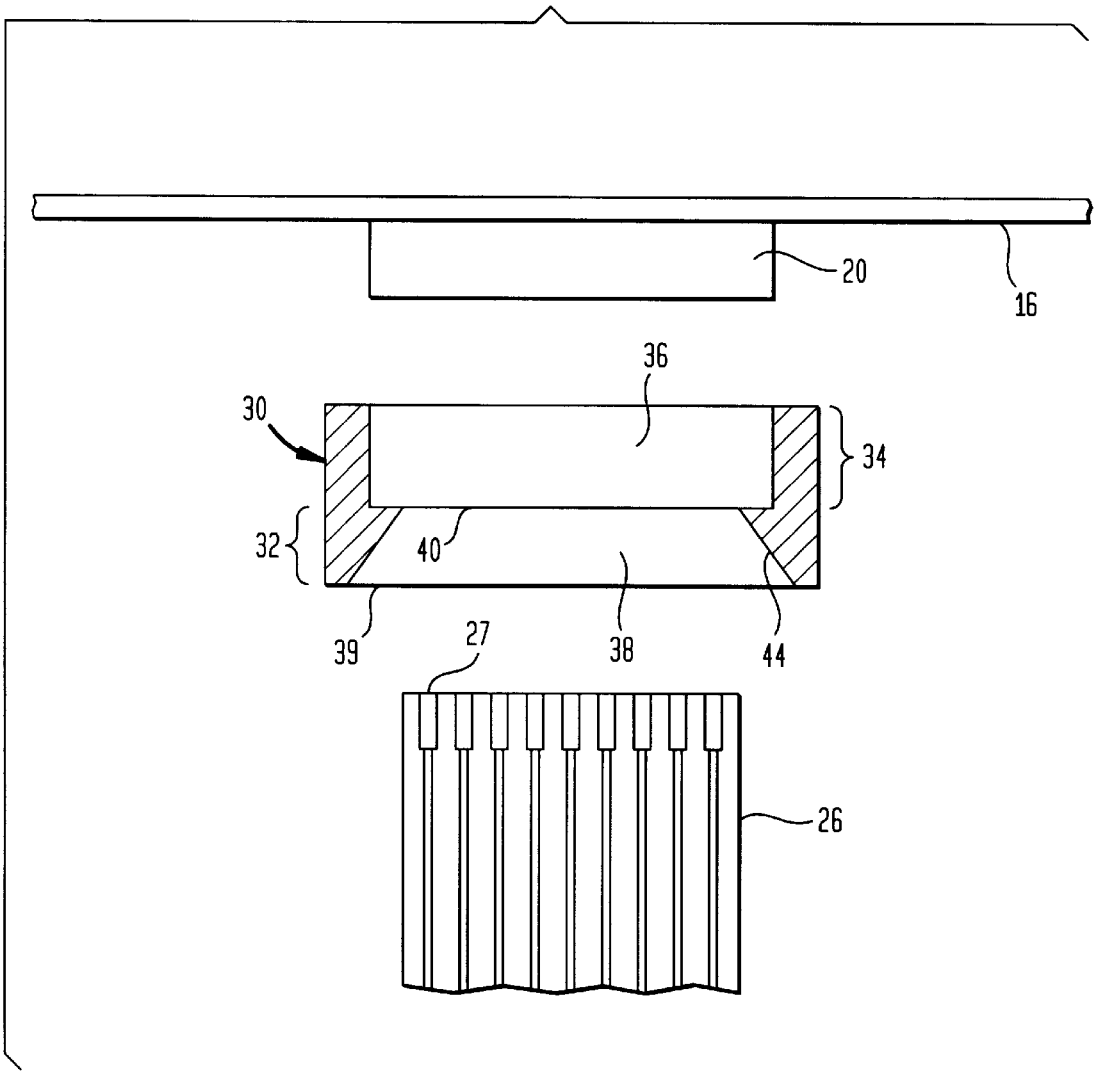
FIG. 3 is a cross-sectional view of the embodiment of FIG. 1, viewed along section line 3—3.
Figure 4:
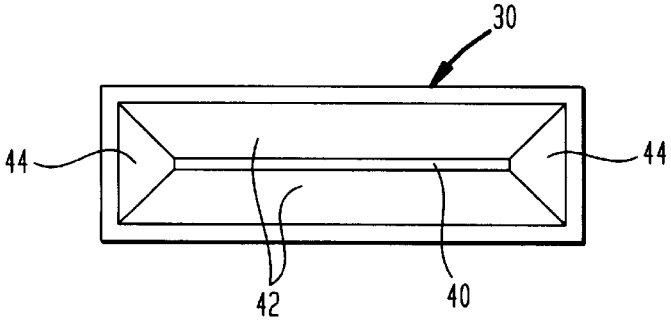
FIG. 4 is a top view of an alignment collar in accordance with the present invention.

Referring to FIG. 3, it can be seen that the base section 34 of the alignment collar 30 defines an opening 36 that is sized to receive the first female connector 20 with a slight interference fit. The mouth section 32 of the alignment collar 30 defines a tapered opening 38 that is widest at the top edge 39 of the alignment collar and narrowest at a slot 40 that exists at the interface between the mouth section 34 and the base section 32 of the alignment collar 30. Referring briefly to FIG. 4 in conjunction with FIG. 3, it can be seen that the mouth section 34 of the alignment collar 30 has two opposing long walls 42 and two opposing short walls 44. Both the long walls 42 and the short walls 44 taper towards the slot 40.

Returning to FIG. 3, it will be understood that as the top edge 27 of the flat cable 26 enters the alignment collar 30, the top edge 27 of the flat cable 26 contacts the sloped long walls 42 (FIG. 4) and/or the sloped short walls 44 of the alignment collar 30. The sloped long walls and the sloped short walls guide the top edge 27 of the flat cable 26 toward the slot 40. As the top edge 27 of the flat cable 26 is moved toward the slot 40, the orientation of the top edge 27 of the flat cable 26 is changed. By the time the top edge 27 of the flat cable 26 passes through the slot 40, the top edge 27 of the flat cable 26 is reoriented into the same plane as is the first female connector 20. The top edge 27 of the flat cable 26 then enters the first female connector 20, wherein the flat cable 26 is engaged by the first female connector 20. An electrical connection is thereby completed between the second female connector 22 (FIG. 1) on the second printed circuit board 18 (FIG. 1) and the first female connector 20 on the first printed circuit board 16, regardless that both connectors are not aligned in parallel planes.

Returning to FIG. 1, it will be understood that when the upper housing subassembly 12 is connected to the lower housing subassembly 14, a predetermined gap will exist between the first printed circuit board 16 and the second printed circuit board 18. The length of the flat cable 26 is selected to be slightly larger than that predetermined gap, so that the flat cable 26 is capable of spanning the gap, changing orientation and engaging the first and second female connectors 20, 22.

To assemble the shown telephone using the present invention connector device, the upper housing subassembly 12 is included with the first printed circuit board 16. Similarly, the lower housing subassembly 14 is included with the second printed circuit board 18. The flat cable 26 is placed into the female receptacle 22 on the second printed circuit board 18. The alignment collar 30 is then placed over the female connector 20 on the first printed circuit board 16.

As the upper housing subassembly 12 and the lower housing subassembly 14 are joined together, the free end 27 of the flat cable 26 enters the alignment collar. The alignment collar 30 reorients the flat cable 26 so that it properly aligns with the female connector 20 on the first printed circuit board 16. As the two housing subassemblies 12, 14 are firmly pressed together, the rigidity of the flat cable 26 forces the flat cable 26 to enter and engage the female connector 20 on the first printed circuit board 16, thereby completing the desired connections between the first printed circuit board 16 and the second printed circuit board 18.

The interconnection between the first printed circuit board and the second printed circuit board can be done in a blind assembly procedure. The blind assembly procedure does not require soldering or the precise alignment of components.

Furthermore, since the flat cable is only slightly larger than the gap it spans, the flat cable does not lay across either the first printed circuit board or the second printed circuit board and therefore does not cause signal interference.

It will be understood that the embodiment of the present invention specifically shown and described is merely exemplary and that a person skilled in the art can make alternate embodiments using different configurations and functionally equivalent components. For example, the size of the flat cable or other type of cable used can be varied to meet the needs of a specific application. Accordingly, the size of the female connectors and the alignment collar can be adjusted to match the size of the flat cable. Also male and female connectors may be respectively reversed on the flat cable and/or circuit boards. Also the function of the alignment collar may be built into the connectors. All such alternate embodiments are intended to be included in the scope of this invention as set forth in the following claims.

What is claimed is:

1. An assembly for electrically interconnecting a first printed circuit board to a second printed circuit board, said assembly comprising:

a cable having a first end and a second end, wherein said cable is flexible enough to bend without breakage yet is rigid enough to stand erect when supported from one end;

a first connector on the first printed circuit board, wherein said first connector is adapted to receive said first end of said cable;

a second connector on the second printed circuit board, wherein said second connector is adapted to receive said second end of said cable; and an alignment collar for guiding said first end of said cable into said first connector.

2. The assembly according to claim 1, wherein said cable contains a plurality of conductive pathways extending from said first end to said second end.

3. The assembly according to claim 2, wherein each of said plurality of conductive pathways has a termination at said first end of said cable and said second end of said cable.

4. The assembly according to claim 1, wherein said alignment collar engages said first connector with an interference fit.

5. The assembly according to claim 1, wherein said cable is a flat cable and said alignment collar has a tapered opening that tapers from a wide mouth to a narrow slot.

6. The assembly according to claim 5, wherein said narrow slot is aligned with said first connector, wherein said first end of said cable enters said first connector when passing through said slot.

7. The assembly according to claim 1, wherein said first connector supports said first end of said cable in a first orientation and said second connector supports said second end of said cable in a second orientation, wherein said first orientation and said second orientation are not in common planes.

8. A method of interconnecting a first printed circuit board to a second printed circuit board, wherein the first printed circuit board and the second printed circuit board are spaced a predetermined distance apart within an assembly, said method comprising the step of:

providing a first cable connector on the first printed circuit board;

providing a second cable connector on the second printed circuit board;

providing a cable having a first end and a second end, wherein said cable is flexible enough to bend without breakage yet is rigid enough to stand erect when supported from said first end by said second cable connector;

connecting an alignment collar to said first cable connector;

placing said second end of said cable in said second cable connector; and positioning the second printed circuit board over the first printed circuit board, wherein said first end of said cable enters said alignment collar and is received by said first cable connector.

9. The method according to claim 8, wherein said first cable connector is oriented in a first plane and said second cable connector is oriented in a second plane that is different than said first plane.

10. The method according to claim 9, wherein said second cable connector supports said cable in said second plane and said alignment collar bends said cable, wherein said first end of said cable is reoriented into said first plane.

11. The method according to claim 8, wherein said cable contains a plurality of conductive pathways extending from said first end to said second end.

12. The method according to claim 11, wherein each of said plurality of conductive pathways has a termination at said first end of said cable and said second end of said cable that are electrically engaged by said first cable connector and said second cable connector, respectively.

13. The method according to claim 8, wherein said step of connecting an alignment collar includes placing an alignment collar over said first cable connector and securing said alignment collar in place with an interference fit.

14. The method according to claim 8, wherein said cable is a flat cable and said alignment collar has a tapered opening that tapers from a wide mouth to a narrow slot.

15. The method according to claim 14, wherein said narrow slot is aligned with said first connector, whereby said first end of said cable enters said first connector when passing through said slot.

16. In an assembly having a first portion and a second portion, wherein a first circuit board is contained within the first portion and a second circuit board is contained within the second portion, a method of interconnecting the first circuit board to the second circuit board when the first portion of the assembly is assembled to the second portion of the assembly, comprising the steps of:

attaching a cable to the second circuit board, wherein said cable extends upwardly from the second circuit board and terminates at a free end, and wherein said cable is flexible enough to bend without breakage yet is rigid enough to stand erect when supported from said first end by said second cable connector;

providing a cable connector on said first circuit board, wherein said cable connector is capable of receiving said free end of said cable; and placing an alignment collar over said cable connector, wherein said alignment collar receives said free end of said cable and guides the free end of the cable into said cable connector as the first portion of the assembly is assembled to the second portion of the assembly.

17. The method according to claim 16, wherein said first circuit board is oriented in a first plane and said second circuit board is oriented in a second plane that is different than said first plane.

18. The method according to claim 17, wherein said cable extends from said second circuit board generally perpendicularly to said second plane and said alignment collar bends said cable and reorients said free end of said cable into said first plane.

19. The method according to claim 16, wherein said cable is affixed to said second circuit board via a second cable connector.

20. An alignment collar device to facilitate connections of printed circuit boards utilizing flat cable wherein said cable is flexible enough to bend without breakage yet is rigid enough to stand erect, said printed circuit boards having connectors thereon for mating with ends of said flat cable, said alignment collar comprising:

a base portion for engaging a connector on a printed circuit board; and a receiving portion having at least four walls defining a tapered opening where each of said four walls tapers from a wide mouth to a narrow slot, said narrow slot being aligned with said connector, wherein an end of said cable enters said wide mouth and is guided into said narrow slot to thereby be aligned and coupled with said connector.

21. The device of claim 20, wherein said base portion of said collar engages said connector with an interference fit.

* * * * *